United States Patent [19]

Ziemba et al.

[11] 4,291,627

[45] Sep. 29, 1981

[54] ELECTRICAL FUZE WITH A PLURALITY OF MODES OF OPERATION

[75] Inventors: Richard T. Ziemba, Burlington, Vt.; Joseph A. Kinzel, Liverpool; Myron D. Egtvedt, Skaneateles, both of N.Y.

[73] Assignee: General Electric Company, Burlington, Vt.

[21] Appl. No.: 97,763

[22] Filed: Nov. 27, 1979

[51] Int. Cl.[3] ..... F42C 11/00

[52] U.S. Cl. ..... 102/265; 102/211

[58] Field of Search ..... 102/265, 270, 271, 218, 102/219, 220, 211

[56] References Cited

U.S. PATENT DOCUMENTS

| | | | |
|---|---|---|---|
| 2,505,042 | 4/1950 | Gourdon | 102/211 |
| 3,608,494 | 9/1971 | Ziemba | 102/235 |
| 3,714,898 | 2/1973 | Ziemba | 102/215 |
| 3,844,217 | 10/1974 | Ziemba | 102/276 |
| 3,871,296 | 3/1975 | Heilprin et al. | 102/211 |
| 3,877,378 | 4/1975 | Clark et al. | 102/270 |
| 4,015,531 | 4/1977 | Ziemba | 102/276 |
| 4,033,266 | 7/1977 | Ziemba | 102/216 |
| 4,044,680 | 8/1977 | Ziemba | 102/216 |
| 4,091,733 | 5/1978 | Ziemba | 102/209 |

*Primary Examiner*—Charles T. Jordan

*Attorney, Agent, or Firm*—Bailin L. Kuch

[57] ABSTRACT

A feature of this invention is the provision of a fuze having a plate which serves both as a full frontal area impact switch and an electrostatic sensor to provide detonation signals.

8 Claims, 2 Drawing Figures

ELECTRICAL FUZE WITH A PLURALITY OF MODES OF OPERATION

BACKGROUND OF THE INVENTION

1. Field of the Invention

This invention relates to electrically detonated fuzes for ammunition, particularly to a fuze which after firing may be operated in any one of a plurality of modes, e.g., remote set, proximity or impact.

2. Prior Art

U.S. Pat. No. 4,015,531 issued Apr. 5, 1977 to R. T. Ziemba discloses a fuze having at time of firing, in-gun selectable, superquick, and delayed modes of operation, and also a self-destruct mode of operation.

U.S. Pat. No. 4,044,680 issued Aug. 30, 1977 to R. T. Ziemba discloses a fuze having in-flight, remote selectable impact, airburst or canopy modes of operation.

U.S. Pat. No. 3,714,898 issued Feb. 6, 1973 to R. T. Ziemba discloses a fuze having an in-flight, remote set mode of operation.

U.S. Pat. No. 3,877,378 issued Apr. 15, 1975 to F. T. Clark et al. discloses a fuze which releases dust to generate, in-flight, static charge on the fuze and a generator enables a trigger circuit to receive a "firing signal" from the target. An impact mode of operation is also provided.

SUMMARY OF THE INVENTION

It is an object of this invention to provide a fuze which may be in-flight, remotely set, and which also has a passive proximity mode of operation, and an impact mode of operation.

It is another object of this invention to provide such a fuze wherein the impact contacts also serve as the proximity capacitor plates.

A feature of this invention is the provision of a fuze having a plate which serves both as a full frontal area impact switch and an electrostatic sensor to provide detonation signals.

Another feature is the use of an RF remote set timer located in a rearward section having a favorable rear-to-front antenna gain characteristic, and simple means for connecting antenna to receiver.

Yet another feature is the connection of the power and timer output, located in the rearward section, to the trigger circuit in the forward section, over a single connector, permitting a safe high pressure sealed connection into the warhead (forward) section and retaining the screw-together assembly configuration.

Still another feature is the trigger circuit which operates from timed, impact, or electrostatic sensor (proximity) modes, functioning on the first one received.

BRIEF DESCRIPTION OF THE DRAWING

These and other objects, advantages and features of this invention will be apparent from the following specification thereof taken in conjunction with the accompanying drawing in which.

DESCRIPTION OF THE INVENTION

Figure 1:
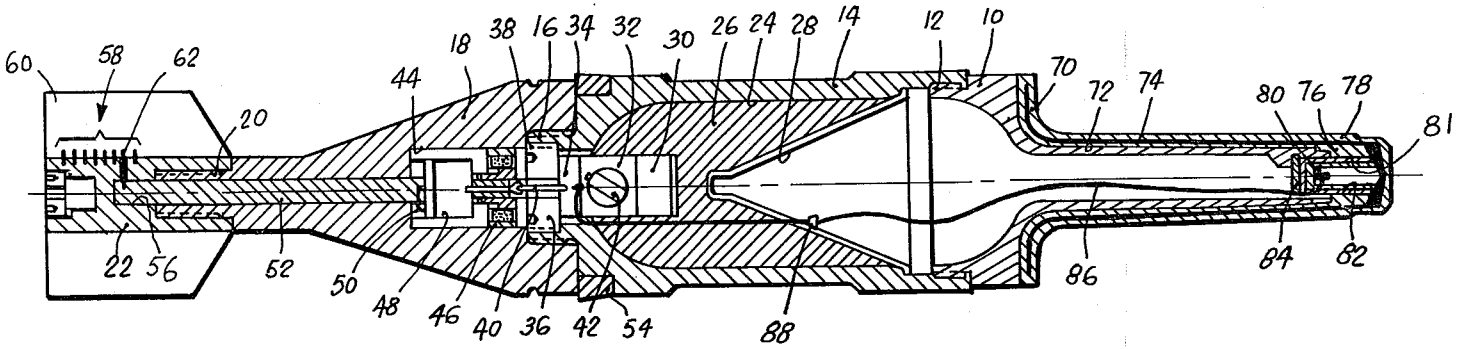
FIG. 1 is a longitudinal cross-section of a round of ammunition incorporating a fuze embodying this invention.
Figure 2:
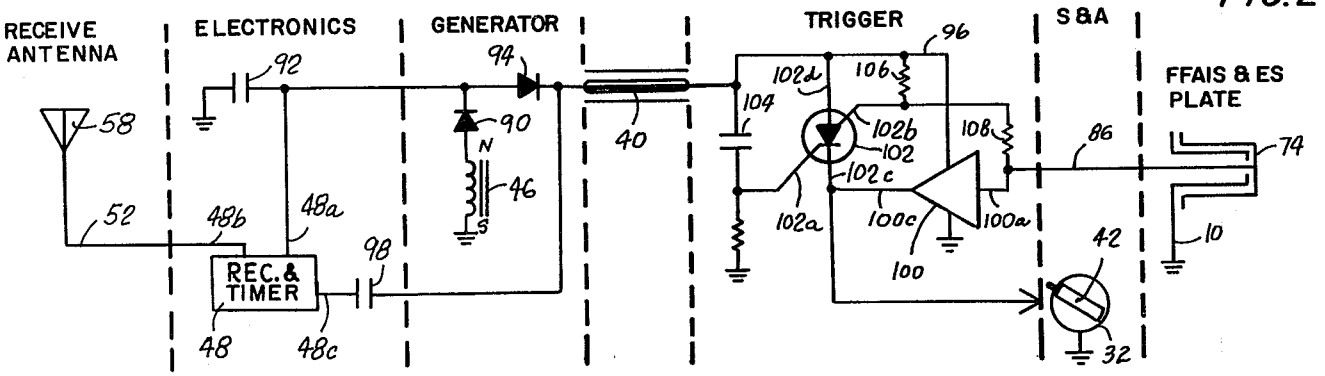
FIG. 2 is a schematic diagram of the fuze of FIG. 1.

FIG. 1 shows a 105 mm, fin stabilized, High Explosive Anti-Tank, Multipurpose round of ammunition, with a shaped charged warhead and a distributed fuze.

However, the fuze may be incorporated in other rounds of ammunition, including spin stabilized and larger and smaller rounds, e.g., 30 mm, 120 mm.

The round includes a forward housing 10, threaded at 12 to a middle housing 14, which is threaded at 16 to an aft housing 18, which is threaded at 20 to a tail assembly 22, and are all made of electrically conductive material.

The middle housing 14 has an internal cavity 24 in which is disposed a shaped charge warhead 26 with a forward liner 28, a booster charge 30, a safing and arming rotor assembly 32, a trigger circuit 34, and a plug 36 threaded in at 38 with a single conductor high pressure feedthrough 40. The safing and arming rotor assembly 32 and the booster charge 30 may be generally of the type shown in U.S. Pat. No. 3,608,494 issued Sept. 28, 1971 to R. T. Ziemba, but with a spring, instead of centrifugal force, utilized to torque the rotor into firing alignment; and with an electrical detonator charge 42 in lieu of a percussion detonator charge, as shown in U.S. Pat. No. 4,033,266 issued July 5, 1977 to R. T. Ziemba.

The aft housing 18 has an internal cavity 44 in which is disposed a setback generator 46 and a radio receiver and timer assembly 48 which is coupled to an excitation probe 50 which is disposed in a dielectric filled, circular waveguide 52 which extends into the tail assembly. The setback generator may be of the type shown in U.S. Pat. No. 4,091,733 issued May 30, 1978 to R. T. Ziemba. The receiver and timer assembly 48 may be of the type shown in U.S. Pat. No. 3,844,217 issued Oct. 29, 1974 to R. T. Ziemba. An annular gas obturator 54 is captured between the aft and the middle housings.

The tail assembly 22 has an internal cavity 56 which receives the aft end of the waveguide 52. A receiver antenna assembly 58 is fixed in the tail assembly between the fins 60, and may comprise a yagi with a stub 62 extending as an excitation probe into the aft end of the waveguide.

A nose assembly 70 having a tubular nose 72 is fixed to the forward housing 10. The nose assembly includes a metal cup-shaped plate 74 which is fixed between two layers 76 and 78 of a dielectric material. A metal cup 80 is held in electrical contact, through a bore 81 in the dielectric layer 76, with the plate 74 and insulated from the housing 10, and a disc 84, by a cup 82 made of a dielectric material.

An insulated conductor 86 is electrically connected to the metal cup 80 and passes, via radial holes in the two cups and a channel in the nose 72, and via a bore 88 through the shaped charge and its liner, to the trigger circuit 34.

Prior to firing, the rotor of the safing and arming assembly 32 is angularly displaced so that the detonator 42 is out of electrical contact with the trigger 34. Upon firing, the rotor is mechanically driven to align the detonator to complete the electrical circuit.

The setback generator 46 is coupled through a diode 90 to a storage capacitor 92, and to the B+ input terminal 48*a* of the receiver and timer assembly 48, and also via a diode 94 and the single conductor feedthrough 40 to a B+ bus 96. The antenna assembly 58 is coupled via the waveguide 52 to the signal input terminal 48*b* of the assembly 48. The signal output terminal 48*c* of the assembly 48 is coupled via a coupling capacitor 98 to the single conductor feedthrough 40.

The trigger circuit 34 includes a high gain bandpass amplifier 100 whose input terminal 100*a* is coupled to the conductor 86 and thereby to the plate 74. The output terminal 100*c* of the amplifier is coupled to the cathode terminal 102*c* of a silicon controlled switch 102. The bandpass characteristic of the amplifier 100 provides a lowpass function to discriminate against impact of charged raindrops, lightning, and other abrupt phenomena, and a highpass function to discriminate against slow charge buildups. The amplifier output 100*c* will have a pull-up characteristic similar to an open-collector PNP transistor whose emitter is connected to B+ bus 96, thus providing a negligible load to the cathode of the SCS 102. The conductor 86 is also coupled through a resistance 108 to the anode gate trigger terminal 102*b* of the SCS 102, which is also connected through a resistor 106 to the B+ bus 96. The cathode gate trigger input terminal 102*a* is also coupled to the B+ line 96 via a coupling capacitor 104. The anode terminal 102*d* of the switch is coupled to the B+ line 96, and the cathode terminal is coupled to the detonator 42 if and when the detonator has turned to its aligned position.

In use, upon the setback occurring after firing, the armature of the setback generator 46 shifts aft relative to its coil and induces a voltage in the coil (e.g. 15 v.) which is coupled through the diode 90 and charges the storage capacitor 92. This voltage is also coupled through the diode 94 and through the single conductor feedthrough 40. A mechanical drive causes the rotor assembly 32 to turn and align the detonator 42.

Pulses may be transmitted in a coded and uncoded (pulse counting) format, to the fuze and received by the antenna 58 and coupled to the timer 48 to preset the time of flight of the fuze to detonation as shown in U.S. Pat. No. 3,844,217 supra. Should the fuze impact a target prior to the preset time, the nose assembly will crush up, and the assembly of the plate 74 and the cup 80 will electrically contact the forward housing 10, which together form a dull frontal area impact switch, thereby connecting the anode gate trigger terminal 102*b* of the silicon control switch 102 through a resistor 108 to ground to cause the switch 102 to connect B+ from the B+ line 96 to the detonator 42, if the detonator is aligned. Should the fuze enter a volume of air having a positive charge, such as is developed around a flying helicopter, the positively charged volume will induce a negative charge on the plate 74, which will provide a positive signal at the input terminal 100*a* of the amplifier 100 whose output terminal 100*c* will provide a firing pulse to the detonator, if the detonator is aligned. When the timer 48 reaches its preset time, the output terminal 48*c* via the coupling capacitor 98 provides a positive pulse to the B+ line 96 which is coupled via the coupling capacitor 104 to the gate trigger terminal 102*a* of the SCS 102, to cause the SCS 102 to connect B+ to the detonator, if the detonator is aligned.

It may be noted that the single conductor, ceramic in metal, hermetically sealed, high pressure feedthrough 40 effectively seals the aft portion of the fuze which contains the electronics, from the forward portion of the fuze. Both B+ and the trigger signal are carried over the single conductor. The diode 94 isolates the storage capacitor 92 from the trigger signal.

It may also be noted that in conventional projectile fuzes, the antenna is mounted in the ogive or nose section, with the result that at high radio frequencies, where the maximum diameter of the projectile is equal to several wavelengths of the frequency, the coverage to the rear of the antenna pattern is determined by diffraction from the large diameter of the projectile. For example, a 105 mm projectile will have a pattern of coverage to the rear consistent with an antenna having a 105 mm aperture. Such coverage is often smaller than desirable. Other types of flush mounted antennas are mounted on the circumference of the body of the projectile. Such antennas also have narrow beam coverage to the rear. Further, such ogival or body antennas have relatively low gain to the rear compared to gain broadside to the projectile. The patterns of coverage of both types of antenna are basically a function of the maximum diameter of the projectile. The fact that the projectile may be tapered towards the rear does not have significant influence on the antenna pattern coverage to the rear.

The radio frequency receiver of this invention takes into account the tapered outside configuration of the projectile to achieve good radiation coverage and good gain in the rearward direction, while also achieving a good, high ratio of rearward coverage to forward coverage, as desired for electronic countermeasure considerations. By mounting the antenna on the boom neck between the fins 60, the antenna pattern coverage to the rear is a function of the relatively small diameter of the neck section, rather than the large diameter of the body. A placement of the antenna forward of the fins would result in a pattern coverage to the rear with a more narrow lobe behavior, lower gain to the rear and a lower ratio of rearward coverage to forward coverage. The placement of the antenna between the fins avoids these limitations. Space limitations for the detector and video electronics are avoided by the use of a dielectrically loaded waveguide to convey the antenna signal to the longitudinal central portion of the projectile where more space is available.

What is claimed is:

1. A fuze for a round of ammunition including a source of electricity (92);

an electrical detonator (42), and first means for providing two alternative circuits for coupling said source of electricity to said electrical detonator to provide detonation thereof, comprising a plate (74) which serves both as a full frontal area impact switch and an electrostatic sensor to provide detonation signals.

2. A fuze according to claim 1 wherein:

said first means further includes switching means (100, 102) coupled to said plate and to said source of electricity and to said electrical detonator for providing conduction from said source to said detonator in response to signals from said plate.

3. A fuze according to claim 2 wherein:

said source of electricity is coupled between a B+ conductor and a ground conductor;

said switching means and said electrical detonator are coupled in series between said B+ conductor and said conductor ground; and said plate is spaced from and adjacent ground and provides a first signal to said switching means upon impact and thereby being short circuited to ground and provides a second signal to said switching means upon developing an electrostatic charge with respect to ground.

4. A fuze according to claim 3 wherein:

said switching means further includes a silicon controlled switch (102) and a high gain amplifier (100);

said switch having an anode gate trigger terminal (102*b*) which is coupled to ground by said plate when said plate is short circuited to said ground conductor, and said switch is thereby caused to conduct B+ to said detonator, said amplifier having an input terminal which is coupled to said plate and an output terminal which is coupled to said detonator whereby when an electrical potential is developed on said plate, a firing potential is provided to said detonator.

5. A fuze according to claim 4 further including:

a receive antenna;

a radio receiver and timer assembly having an input terminal coupled to said receive antenna and an output terminal coupled to said silicon controlled switch, whereby said assembly provides an output signal in a timed response to an input signal and which output signal causes said switch to conduct B+ to said detonator.

6. A fuze according to claim 5 wherein:

said radio receiver and timer assembly output terminal and said source of electricity are both coupled to said silicon controlled switch by said B+ conductor.

7. A fuze according to claim 6 wherein:

said source of electricity and said radio receiver and timer assembly are disposed in an aft housing of said fuze, said switch, said amplifier, said plate and said detonator are disposed in a forward housing of said fuze, and said B+ conductor electrically intercouples said aft and forward housings via a single conductor, hermetically sealed, high pressure feedthrough.

8. A fuze according to claim 5 wherein:

said radio receiver is disposed in an aft housing having an aftmost tail boom of relatively small diameter with a plurality of tail fins radially extending therefrom;

and said receive antenna is disposed on said tail boom between adjacent tail fins.

* * * * *

UNITED STATES PATENT AND TRADEMARK OFFICE

CERTIFICATE OF CORRECTION

PATENT NO. : 4,291,627

DATED : Sept. 29, 1981

INVENTOR(S) : R. T. Ziemba, J. A. Kinzel, M. D. Egtvedt

It is certified that error appears in the above-identified patent and that said Letters Patent are hereby corrected as shown below:

Column 3, line 29, change "and" to --or--,
line 37, change "dull" to --full--.

Signed and Sealed this

*Fifteenth* Day of *December 1981*

[SEAL]

*Attest:*

GERALD J. MOSSINGHOFF

*Attesting Officer*

*Commissioner of Patents and Trademarks*